United States Patent [19]

Mahr et al.

[11] 4,040,530

[45] Aug. 9, 1977

[54] SHAFT FURNACE FEED DEVICE

[75] Inventors: René N. Mahr, Howald-Hesperange; Aloyse J. Engel, Schouweiler, both of Luxembourg

[73] Assignee: S.A. Des Anciens Etablissements Paul Wurth, Luxembourg, Luxembourg

[21] Appl. No.: 702,104

[22] Filed: July 2, 1976

[30] Foreign Application Priority Data

July 11, 1975 Luxembourg ..... 72956

[51] Int. Cl.[2] ..... C21B 7/00

[52] U.S. Cl. ..... 214/35 R; 193/2 R; 222/564

[58] Field of Search ..... 214/17 R, 17 C, 16 R, 214/18 R, 18 V, 35 R, 36, 37; 266/176; 222/328, 564; 193/2 R, 3

[56] References Cited

U.S. PATENT DOCUMENTS

| | | | |
|---|---|---|---|
| 2,975,919 | 3/1961 | Pappas | 214/17 R X |
| 3,485,420 | 12/1969 | Lucas | 222/564 |

*Primary Examiner*—Robert G. Sheridan

[57] ABSTRACT

The service life of the components of a bell-less shaft furnace charging installation is enhanced by controlling the trajectory of charge material delivered thereto to obtain an essentially entirely vertical discharge from a discharge funnel through a feed channel to the furnace. Also, erosion of the wall of the discharge funnel is minimized by creating an annular build up of charge material about the discharge end of the funnel, the material build up extending along the funnel wall to at least the impact region of freely falling charge material delivered thereto.

11 Claims, 1 Drawing Figure

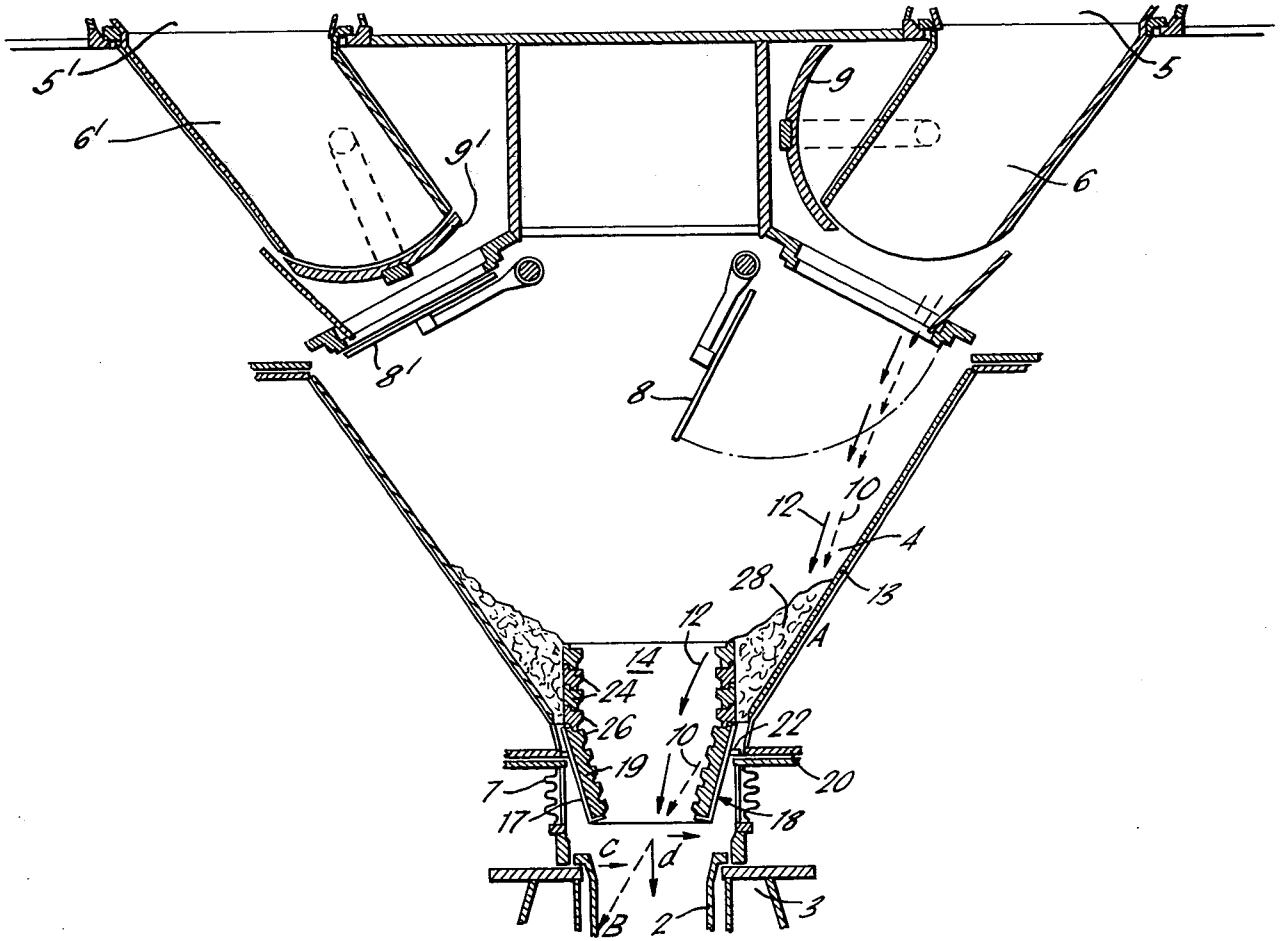
5
6
9
8
10
12
4
13
28
22
20
18
3
2
14
24
26
19
17
7
A
B
C
d
5'
6'
9'
8'

SHAFT FURNACE FEED DEVICE

BACKGROUND OF THE INVENTION

1. Field of the Invention

The present invention relates to the delivery of charge material to the interior of a shaft furnace. More specifically, this invention is directed to methods of and apparatus for reducing component wear is bell-less charging installations for blast furnaces through the exercise of control over the trajectory of material delivered from storage hoppers to a charge distribution chute located within the furnace. Accordingly, the general objects of the present invention are to provide novel and improved methods and apparatus of such character.

2. Description of the Prior Art

Recent developments in the field of high capacity blast furnaces have resulted in the imposition of increasingly exacting demands on the charging devices employed in such furnaces. It is known, for example, that furnace efficiency can be maximized by insuring that the throat gases pass through the furnace charge in an optimum manner. The optimum gas flow, in turn, may be achieved only through exercising close control over the distribution of the furnace charge material on the hearth. The configuration assumed by the charge or burden on the furnace hearth, in turn, depends directly on the charging device employed. Two basic types of charging devices are presently known in the art. The first, which has been in use for many years, employs two superimposed bells. When employing such bell-type charging devices it is inherently impossible to distribute the charge in an even and uniform manner over the surface of the furnace hearth; the charge configuration resulting from use of a bell-type charging device having a characteristic M curve. The second category of charging device, which is achieving increased acceptance and use, is a bell-less charging system which includes a rotatable and angularly adjustable spout located within the furnace. The bell-less charging system is described in U.S. Pat. No. 3,693,812, and improvements thereto are disclosed in U.S. Pat. Nos. 3,814,403 and 3,880,302. The three aforementioned U.S. patents are all assigned to the assignee of the present invention, and reference is made thereto for details of the features disclosed in said patents.

In the apparatus of U.S. Pat. No. 3,693,812, the furnace charge material or burden is stored in two or more intermediate storage bins or hoppers and is supplied to the distribution chute in controlled quantities, through the use of a metering device, via a discharge funnel and a central feed channel. In the manner known in the art, the storage hoppers are operated in accordance with a predetermined cycle; i.e., while one of the hoppers is being filled with charge material the other will be discharging its contents into the discharge funnel from which the material flows through the central feed channel to the distribution chute and thence on to the furnace hearth. the central feed channel is located vertically above the material receiving end of the rotatable distribution chute and coaxially of the mechanism for driving the distribution chute. The discharge funnel, which is of generally frustoconical shape, is vertically above and coaxial with the feed channel; the smaller diameter end of the discharge funnel facing the upstream end of the central feed channel. Referring to U.S. Pat. No. 3,693,812, during charging of the furnace the charge material, for example ore or coke, will be alternately released from the hoppers 2, 2' and will be directed by the discharge funnel 12 into the fixed, vertical feed channel 13. The charge will then be guided by channel 13 onto the upper end of the rotatable and angularly adjustable chute 15. Due to its physical nature, the rapidly moving charge material will cause erosion of the walls of the discharge funnel and feed channel which are contacted thereby. The rate of wear of the sloped side walls of the discharge funnel and the vertical wall of the feed channel is comparatively high since the material delivered from the intermediate storage hoppers to the furnace generally falls over the some trajectory and thus always comes in contact with the same surface areas which, accordingly, experience constant wear.

SUMMARY OF THE INVENTION

The present invention reduces the aforementioned wear on those surfaces of a bell-less charging installation for a shaft furnace which have previously been impinged upon by falling charge material. Accordingly, this invention constitutes an improvement to bell-less furnace charging techniques and apparatus. The improvements resulting from the present invention are accomplished by producing an enhanced distribution of the charge materials falling through the central feed channel and particularly by achieving a vertical discharge of the materials through the central feed channel. In addition to this control of the trajectory of the falling charge material, which substantially reduces the contact between this material and the walls of the feed channel, the present invention also substantially reduces the contact between such materials and the side walls of the discharge funnel. The wear rate of the charge containing and guiding surfaces of the charging installation is further reduced by retarding the speed of movement of the charge material through the discharge funnel and feed channel.

Apparatus in accordance with a preferred embodiment of the invention, for providing the improved operating characteristics as described immediately above, comprises a tubular insert which extends upwardly into the discharge funnel from the smaller diameter end thereof. This insert is shaped to produce material flow therethrough which is substantially without horizontal components of motion. The discharge end of the tubular insert is of smaller diameter than the central feed spout and, accordingly, material falling through the insert will pass through the feed channel without any substantial impingement on the walls thereof. Also, the end of the insert which extends upwardly into the discharge funnel forms a "stone dam" about the lower portion of the funnel whereby charge material being delivered to the funnel will contact previously delivered material rather than the funnel wall. The insert is constructed so as to resist wear and to be readily installed or replaced either in whole or in part.

BRIEF DESCRIPTION OF THE DRAWING

The present invention may be better understood and its numerous objects and advantages will become apparent to those skilled in the art by reference to the accompanying drawing which is a schematic cross-sectional side elevation view of apparatus in accordance with a preferred embodiment of the invention.

DESCRIPTION OF THE PREFERRED EMBODIMENT

With reference now to the drawing, the charging installation which has been partially depicted is of the type disclosed in U.S. Pat. No. 3,693,812. The charging installation thus includes a rotary and angularly adjustable discharge chute, not shown, which is located below the structure depicted. The discharge chute distributes the material constituting the furnace charge over the hearth of the furnace in accordance with a preselected charge profile distribution; the charge consisting of ore, coke, pellets, etc. The charge material is delivered to the distribution chute through a fixed central feed channel 2. Channel 2 will typically be of generally cylindrical internal shape and will be coaxial with the furnace axis. The mechanism for driving the distribution chute will be located within an annular chamber 3 which is to the exterior of and also coaxial with the central feed channel 2. The furnace throat, into which channel 2 extends, is hermetically connected to a discharge funnel 4 by means of a compensator 7. Discharge funnel 4 is served by a pair of intermediate storage hoppers 5 and 5'; the furnace charge material being discharged into funnel 4 from the hoppers 5 and 5' via respective discharge channels 6 and 6'. Control is exercised over the amount and rate of delivery of charge material from the hoppers into funnel 4 by means of retaining and proportioning valves 9 and 9'. The structure and operation of valves 9 and 9' is described in detail in Luxembourg Pat. No. 64,909; Luxembourg Pat. No. 64,909 corresponding to copending U.S. application Ser. No. 339,296. The intermediate storage hoppers 5 and 5' may be isolated from the pressure existing within the furnace, and thus also is funnel 4, by means of respective sealing valves 8 and 8' which are positioned downstream of the proportioning valves 9 and 9'. In the drawing the furnace charging apparatus is delivering charge material to funnel 4. Under these conditions the sealing valve 8 is fully open and the proportioning valve 9 is at least partly open. With material being discharged into the furnace from hopper 5, hopper 5' will be isolated from the conditions existing in the furnace by sealing valve 8' and hopper 5' will be in the process of being recharged with coke, ore, etc. Proportioning valve 9' will, of course, be closed at this time to retain the furnace charge material in hopper 5'.

In the drawing the broken arrows 10 represent the mean or average trajectory of charge materials falling freely from the discharge channel 6 of intermediate storage hopper 5; i.e., the broken arrows 10 represent the prior art. Following arrows 10 it may be seen that the charge material would, prior to the employment of the present invention, impinge upon the wall of funnel 4 approximately in the vicinity of point A. Thereafter, the charge material would slide along the wall of discharge funnel 4 and then again free fall into the central feed channel 2. Due to the velocity acquired by the charge materials moving downwardly under the influence of gravity, the trajectory of the materials downstream of the lower end of funnel 4 previously took the form of a parabola. Thus, charge materials falling into the central feed channel 2 had a horizontal component of motion which resulted in the materials impacting rather violently against the wall of the feed channel in the general area indicated at B. The regions A and B respectively on the walls of funnel 4 and feed channel 2, being continually subjected to the impact of the charge materials, suffered very rapid wear as a consequence of the force of impact and also as a result of sharp edges on the material with which the furnace is charged. The wall of funnel 4 downstream, in the direction of charge material movement, from point or region A was also subjected to considerable wear as a result of sliding friction as the charge materials moved downwardly. While the service life of funnel 4 and feed channel 2 may be enhanced by providing a wear-resistant lining 13 thereon, such a lining typically being comprised of manganese cast steel or austenitic steel, employment of a lining will not eliminate wear and thus will not prevent the ultimate necessity of performing the time consuming task of replacement of these components of the charging installation.

The present invention modifies both the trajectory assumed by and the velocity of the charge materials delivered from funnel 4 into the furnace via feed channel 2 whereby the rate of wear of the feed channel 2 is greatly reduced. In the disclosed embodiment these improvements are achieved through the use of a tubular plug 14 which is positioned in funnel 4 at the neck or smaller diameter end thereof; plug 14 being coaxial with funnel 4 and feed channel 2. The plug 14 is designed and constructed so as to extend upwardly into the interior of funnel 4 so as to form a barrier to the discharge of material from the funnel into the feed channel about the lower end of the funnel. Thus, as may be seen from the drawing, and as will be described in greater detail below, that portion of plug 14 which extends upwardly into funnel 4 results in the formation of a "stone dam" 28 within funnel 4. The barrier or "stone dam" forming section of plug 14 is of cylindrical shape and is defined by a plurality of vertically stacked rings 24. The lower portion of plug 14, indicated generally at 18, is of frustoconical shape and converges in the direction of the central feed channel 2. The frustoconical portion 18 of plug 14 functions to center the discharge from funnel 4 axially with respect to the feed channel 2.

Considering now the construction of plug 14, in a preferred embodiment of the invention the plug comprises a circular outer collar 22 having a flange which rests upon a flange 20 located in the neck of funnel 4. The frustoconical portion 18 of plug 14 consists of an external sheathing 17 and an inner lining 19. The sheath 17 is supported by its own weight on, but could also be mechanically affixed to, the collar 22. The lining 19 is preferably comprised of a plurality of vertically spaced ring-like elements which can be removed and replaced separately. The elements which comprise the lining 19, or a unitary lining if employed, are merely placed in the external sheathing 17 and are held in position by the frustoconical shape thereof. The stack of rings 24 is positioned on the upper end of lining 19 of portion 18 of plug 14 and, because of their interlocking construction, rings 24 will remain in position without recourse to any special assembly device. However, the rings 24 may be rigidly interconnected, by any suitable means, if deemed necessary or desirable.

The lining 19, or the individual elements which define lining 19, and rings 24 are formed from a material which is highly resistant to wear. This may be the same material as that which comprises the lining 13 of discharge funnel 4. The surfaces of plug 14 which are exposed to the falling charge material, and particularly the inner surfaces of rings 24 and the element or elements comprising lining 19, may be either smooth or may be provided with circular projections 26 as shown. The circular projections, if provided, cooperate with the shape of plug 14 to retard the velocity of the falling charge material. This retardation will be enhanced if the material becomes temporarily lodged in the regions between the projections and thus forms small "stone dams" on each projection.

In the preferred embodiment, where the lining 19 is defined by a plurality of elements, both of the conical and frustoconical portions of plug 14 may be repaired by replacement only of those "rings" which have become unduly worn. The servicing of plug 14 is facilitated since the lining 19, either unitary or sectional, preferably merely rests in the sheathing 17 and thus there is no fastening elements to be disconnected.

The height of the stack of rings 24 defining the conical portion of plug 14 is dependent essentially on the dimensions of the discharge funnel 4. Thus, the number of rings 24 is selected to insure that the plug 14 will extend a sufficient distance into funnel 4 to provide an efficient barrier for the charge material. When a feed hopper is being emptied for the first time, subsequent to installation of plug 14, charge material will be "dammed" or held up by the exterior of plug 14 and thus will accumulate behind the rings 24. This accumulation or "stone dam", as indicated at 28, will remain in position until the plug 14 is replaced.

The arrows 12 on the drawing denote the path taken by the descending charge material after the "stone dam" 28 has been created and occupies the entire space between the rings 24 and the wall of discharge funnel 4. If plug 14 extends into funnel 4 a sufficient distance, the materials discharged from the feed hoppers via discharge channels 6 and 6' will not impact on lining 13 of funnel 4 but rather will impinge upon the accumulation of material 28. The charge material will thereafter move along the top of the "stone dam" and will fall into the plug 14. Thus, if the height of plug 14; i.e., the number of rings 24; is properly selected, rapid wear of the lining 13 of discharge funnel 4 is avoided by preventing the impact of falling charge material on the lining and also by obviating the friction which would be produced by charge material sliding along the lining.

Charge material overflowing the "stone dam" 28 falls into plug 14 over the uppermost one of rings 24. The falling charge material takes a path indicated by arrows 12 in traversing the plug 14 and central feed channel 2. The plug 14 effectively interrupts the free fall of and thus decelerates the falling charge material and modifies its trajectory through the feed channel 2. In practice, material being delivered to the furnace drops into plug 14 from the upper ring 24 and, because of its retarded velocity and the shaping function of the frustoconical portion of plug 14, the falling charge material will have substantially no horizontal components of motion. The trajectory of the charge material is shown schematically by the vectors *c* and *d* at the entry to the central feed channel 2 respectively for charging operations without plug 14 being installed and with plug 14 in position. The vector *d*, contrary to vector *c*, is vertical. Thus, the removal of the horizontal components of motion from the trajectories of the descending discharge from funnel 4 results primarily from the formation of the "stone dam" 28 in the neck of funnel 4 which reduces the velocity of descent and modifies the trajectory followed by the material.

As will now be obvious to those skilled in the art, the formation of the "stone dam" 28, and the utilization of plug 14, enables the discharge through the central feed channel to be centered and avoids rapid wear of those components of the charging installation which have previously been principally exposed to abrasion resulting from the falling material. Tests have shown that the control of the trajectory of the charge material, whereby the material moves substantially in a vertical direction only and through the center of the feed channel, not only reduces or eliminates the impact of the charge materials on the walls of the feed channel but also facilitates and speeds up the operation of charging the furnace.

While a preferred embodiment has been shown and described, various modifications and substitutions may be made thereto without departing from the spirit and scope of the invention. Accordingly, it will be understood that the present invention has been described by way of illustration and not limitation.

What is claimed is:

1. In a furnace charging installation, the installation including at least a first storage hopper and a movable distribution chute, the charging installation also including a discharge funnel and a feed channel which serially guide charge material released from the hopper to the chute, the improvement comprising:

a tubular plug positioned in the small diameter end of the discharge funnel, said plug extending upwardly into the funnel in spaced relationship to the inner wall thereof to define a cavity for receiving and holding charge material between the outer wall of said plug and the inner wall of said funnel whereby an accumulation of charge material is caused to form about the smaller diameter discharge end of the funnel, the accumulated charge material extending upwardly along the funnel wall at least to the region of impact of freely falling material released into the funnel from the hopper.

2. The apparatus of claim 1 wherein at least that portion of said plug which extends upwardly into said funnel in spaced relationship to the wall thereof is defined by a plurality of vertically stacked ring-like elements.

3. The apparatus of claim 2 wherein said vertically stacked ring-like elements are provided with circular projections which extend into said plug.

4. The apparatus of claim 2 wherein said tubular plug further comprises:

a frustoconical section which extends downstream in the direction of charge material movement from the vertically stacked ring-like elements, said frustoconical plug section having an internal diameter which converges in the direction of the feed channel.

5. The apparatus of claim 4 wherein said vertically stacked ring-like elements are provided with circular projections which extend into said plug.

6. The apparatus of claim 5 wherein said frustoconical plug portion is provided with inwardly extending circular internal projections.

7. The apparatus of claim 1 wherein said tubular plug further comprises:

a frustoconical section which extends downstream in the direction of charge material movement from the portion of said plug which extends upwardly into said funnel, said frustoconical plug section having an internal diameter which converger in the direction of the feed channel.

8. The apparatus of claim 7 wherein the portion of said plug which extends upwardly into said funnel is of generally cylindrical shape.

9. The apparatus of claim 7 wherein said tubular plug further comprises:

a circular outer collar, said collar resting on a flange in the region of the throat of said funnel.

10. The apparatus of claim 9 wherein said frustoconical plug section comprises:

a frustoconical outer sheath, said sheath being supported in said collar; and an inner lining comprised of wear resistant material, said inner lining defining a converging passage and having an outer diameter commensurate with the inner diameter of said sheath.

11. The apparatus of claim 1 wherein at least that portion of said plug which extends upwardly into the funnel is provided with inwardly extending projections.

* * * * *

UNITED STATES PATENT AND TRADEMARK OFFICE

CERTIFICATE OF CORRECTION

PATENT NO. : 4,040,530

DATED : August 9, 1977

INVENTOR(S) : René N. Mahr, et al

It is certified that error appears in the above-identified patent and that said Letters Patent are hereby corrected as shown below:

Column 1, line 60, ". the" should be --. The--

Column 2, line 13, "some" should be --same--

Column 3, line 38, after "apparatus" the following has been omitted: --is shown in the condition wherein intermediate storage hopper 5--

Signed and Sealed this

*Fourteenth* Day of *February 1978*

[SEAL]

*Attest:*

RUTH C. MASON
*Attesting Officer*

LUTRELLE F. PARKER
*Acting Commissioner of Patents and Trademarks*